US006100635A

United States Patent [19]

Winsor

[11] Patent Number: 6,100,635

[45] Date of Patent: Aug. 8, 2000

[54] SMALL, HIGH EFFICIENCY PLANAR FLUORESCENT LAMP

[75] Inventor: Mark D. Winsor, Seattle, Wash.

[73] Assignee: Winsor Corporation, Tumwater, Wash.

[21] Appl. No.: 09/017,264

[22] Filed: Feb. 2, 1998

[51] Int. Cl.[7] ..... H01J 1/62; H01J 17/16

[52] U.S. Cl. ..... 313/493; 313/491; 313/631; 313/633; 313/634

[58] Field of Search ..... 313/493, 609, 313/610, 611, 634, 483, 485, 491, 633, 473, 475, 636, 631

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |

(List continued on next page.)

FOREIGN PATENT DOCUMENTS

| | | | |
|---|---|---|---|
| 0 066 495 A2 | 12/1982 | European Pat. Off. | H01J 61/32 |
| 0 329 226 A1 | 8/1989 | European Pat. Off. | H01J 65/04 |
| 0 550 047 A1 | 7/1993 | European Pat. Off. | H01J 61/70 |
| 89 04 853 U | 8/1989 | Germany | H01J 61/67 |
| 39 22 865 A1 | 1/1991 | Germany | H01J 65/04 |
| 43 13 017 A1 | 12/1994 | Germany | H01J 61/70 |
| 60-216435 | 10/1985 | Japan . | |
| 62-208536 | 9/1987 | Japan . | |
| 1017374 | 1/1989 | Japan . | |
| 64-17374 | 1/1989 | Japan | H01J 61/30 |
| 1206553 | 8/1989 | Japan . | |
| 2-72552 | 3/1990 | Japan | H01J 61/30 |
| 2-78147 | 3/1990 | Japan | H01J 61/30 |
| 3-46748 | 2/1991 | Japan | H01J 61/94 |
| 3-129659 | 6/1991 | Japan | H01J 61/35 |
| 3-222253 | 10/1991 | Japan | H01J 61/92 |
| 3-285249 | 12/1991 | Japan | H01J 61/32 |
| 4-95337 | 3/1992 | Japan | H01J 61/67 |
| 4-147554 | 5/1992 | Japan | H01J 61/30 |
| 06251876 | 9/1994 | Japan . | |
| 947340 | 1/1964 | United Kingdom . | |
| 2 032 681 | 5/1980 | United Kingdom . | |
| 2 217 515 | 10/1989 | United Kingdom | H01J 61/30 |
| WO 87/04562 | 7/1987 | WIPO . | |
| WO 92/02947 | 2/1992 | WIPO | H01J 61/30 |

OTHER PUBLICATIONS

Mercer et al., "Fluorescent backlights for LCDs," *Information Display*: 8–13, Nov. 1989.

Hinotani et al., "Flat Fluorescent Lamp for LCD Back–Light," *1988 International Display Research Conference*.

*Primary Examiner*—Vip Patel
*Assistant Examiner*—Joseph Williams
*Attorney, Agent, or Firm*—Michael J. Donohue; Seed IP Law Group PLLC

[57] ABSTRACT

A small fluorescent lamp having improved efficiency is described. The lamp includes a lamp body having a serpentine channel therein. The serpentine channel is arcuate in cross section with a fluorescent coating covering the serpentine channel but not the lamp cover to produce an aperture effect. The serpentine channel is reflective such that the cross section forms an aperture effect lamp to improve efficiency. Efficiency is further improved by raising the pressure within the lamp to 70–120 torr. Further efficiency is obtained by limiting the depth of the serpentine channel relative to the width of the serpentine channel such that the electrical discharge is confined within a small cross sectional area. In one embodiment, secondary housings are attached to the lower surface of the lamp to conceal the electrodes beneath the lamp, thereby improving the uniformity of the lamp.

27 Claims, 5 Drawing Sheets

U.S. PATENT DOCUMENTS

| | | | |
|---|---|---|---|
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,837,519 | 6/1989 | Lopertrone et al. | 324/529 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,420,481 | 5/1995 | McCanney | 315/291 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,616,989 | 4/1997 | Taillie et al. | 315/32 |
| 5,645,337 | 7/1997 | Gleckman | 362/29 |
| 5,818,164 | 10/1998 | Winsor | 313/493 |
| 5,820,122 | 12/1998 | Winsor | 313/493 |
| 5,841,230 | 11/1998 | Ikoma et al. | 313/506 |
| 5,903,095 | 5/1999 | Yoshida et al. | 313/485 |
| 5,903,096 | 5/1999 | Winsor | 313/493 |
| 5,914,560 | 6/1999 | Winsor | 313/493 |

SMALL, HIGH EFFICIENCY PLANAR FLUORESCENT LAMP

TECHNICAL FIELD

The present invention relates to fluorescent lamps, and more particularly, to high efficiency, small fluorescent lamps.

BACKGROUND OF THE INVENTION

Small, efficient, durable planar fluorescent lamps are useful in many applications, including head-mounted displays such as those used in virtual reality headsets. Important considerations in such applications are the efficiency of the lamp, the uniformity of illumination provided by the lamp and lifetime of the lamp.

Inefficient lamps require high power input to attain an adequate level of illumination. However, operation at high power levels is undesirable for several reasons. For example, the cost and complexity of voltage sources is increased as the voltage level increases. In many applications, a high voltage input may also pose a shock hazard to a user. Further, at higher voltages, sputtering of electrodes may be increased reducing the lifetime of the lamp.

Nonuniformity of illumination is also undesirable. Lack of uniformity degrades the appearance of the lamp. Moreover, uneven illumination can cause backlit displays to appear uneven and, in some cases, render portions of the display unreadable.

Inadequate lifetimes of such lamps increases the cost of providing a light source. Also, where such lamps are used as part of a larger unit, failure of the lamps may require disassembly or replacement of a much larger unit. For example, where such lamps are used as backlights for flat panel displays, their replacement can be difficult and expensive.

As is known, efficiency of fluorescent lamps can be improved by increasing the discharge length between electrodes. However, in small lamps, the achievable discharge length is restricted by the small dimensions of the lamps. To lengthen the effective discharge length and thereby improve the efficiency of such lamps, serpentine discharge paths are sometimes defined within the lamps to cause the electrical discharge to follow a serpentine pathway between the electrodes.

Even where a serpentine path is used, efficiencies of the lamps are often quite low. To further improve their efficiency, such lamps can also be operated at temperatures well above ambient temperature. However, running the lamps at high temperatures is disadvantageous for several reasons. First, the heat generated by the lamp can make the lamps uncomfortable or dangerous in head-mounted displays such as virtual reality headsets. Also, operating lamps at such high temperatures consumes excess energy, thereby reducing the efficiency of the lamps. Further, operating lamps at higher temperatures accelerates aging of the lamps, causing premature failure.

The lifetime of small planar lamps can be affected by several factors. As discussed above, operation at higher temperatures reduces the lifetime of the lamp, principally by inducing unnecessary sputtering of the electrodes. Also, heating and cooling of the lamp can cause mechanical failure of the lamp due to a variety of factors. For example, heat-induced expansion and contraction can stress joints in the lamp or cause flexure of portions of the lamp, as is known. High voltage and high temperature may also induce migration of ions through materials forming the lamp. These ions may, in turn, form conductive paths, or shortcuts, across the lamp, which can impair the uniformity and efficiency of the lamp.

SUMMARY OF THE INVENTION

A small, planar fluorescent lamp includes an insulative lamp body including a base with a pair of sidewalls and a pair of endwalls connected to the base to form a recessed. A lamp cover overlays the recessed and is sealed to the sidewalls and endwalls to form a chamber. A gas within the chamber includes mercury vapor and is responsive to emit ultraviolet energy in response to an electrical stimulation. Within the chamber, first and second channel walls project from the base toward the cover with the first wall extending from the first endwall toward the second endwall and the second channel wall extending from the second endwall toward the first endwall. The base, endwalls and channel walls define a serpentine channel within the chamber. The first channel wall is separated from the second channel wall by a maximum separation distance $d_c$ and the lower surface of the cover is separated from the upper surface of the base by a maximum distance $d_d$. The ratio of $d_c$ to $d_d$ exceeds 0.5:1 and is preferably between 0.7:1 and 1.3:1. The serpentine channel includes a plurality of channel sections with each channel section having a substantially arcuate cross section. The gas within the chamber is at a pressure between 70 torr and 120 torr. A reflective coating overlays the upper surface of the base in apportion to the channel walls and a layer of fluorescent material overlaying a portion of the base and portions of the first and second channel walls. The fluorescent material has a gap forming an aperture to permit light to exit the optically additive reflector form by the arcuate section.

In one embodiment a housing is bonded to the lamp body with the housing and a portion of the lamp body forming a secondary chamber. The first electrode is positioned within the secondary chamber and a plasma slot in the lamp body forms a passage way between the chamber and the secondary chamber to permit electrical energy to pass between the secondary chamber and the chamber. In one embodiment, the lamp has a diagonal dimension of approximately 1.5 inches and in another embodiment the diagonal measurement is less than 0.7 inch.

In one embodiment, the electrodes are positioned adjacent the ends of the channel sections such that the electrodes produce an electric field at turns in the serpentine channel. The electric field improves the uniformity of light within the lamp, especially in gaps near the center of the lamp. An opaque mask overlays the electrodes and has an aperture above the serpentine channel through which light is emitted.

DETAILED DESCRIPTION OF THE INVENTION

Figure 1:
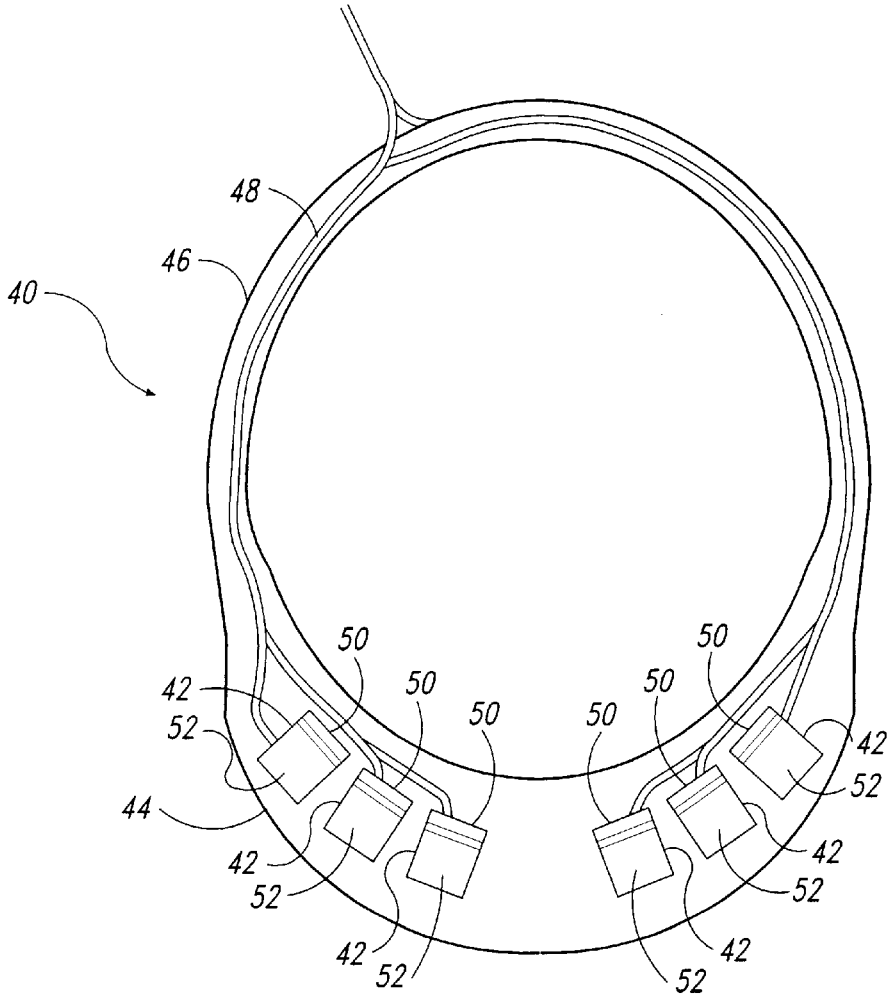
FIG. 1 is a front isometric view of a head-mounted display unit incorporating six lamps according to the invention.

Shown in FIG. 1 is a head-mounted display unit 40 such as that used in a virtual reality system. The head-mounted display unit 40 includes six backlit video displays 42 mounted to a face plate 44 which is supported in front of a viewer's eyes by a head strap 46. The displays 42 are rectangular display screens for presenting video or computer-generated visual images to a viewer.

Three of the displays 42 are mounted for viewing by each of the user's eyes. Successive ones of the three displays 42 are spaced at increasing angles from the center so that together, they present a wide angle image to the viewer. To drive the displays 42, power and data are supplied to the displays 42 by a cable 48 which extends from the headset to a controller (not shown). Each backlit display 42 includes an LCD panel 50, a portion of which is visible in FIG. 1 for displaying images.

The LCD panels 50 are rectangular planar panels of a known type having diagonals typically measuring between 0.5 and 1.5 inches. Backlight for the LCD displays 42 is provided by planar fluorescent lamps 52.

Figure 2:
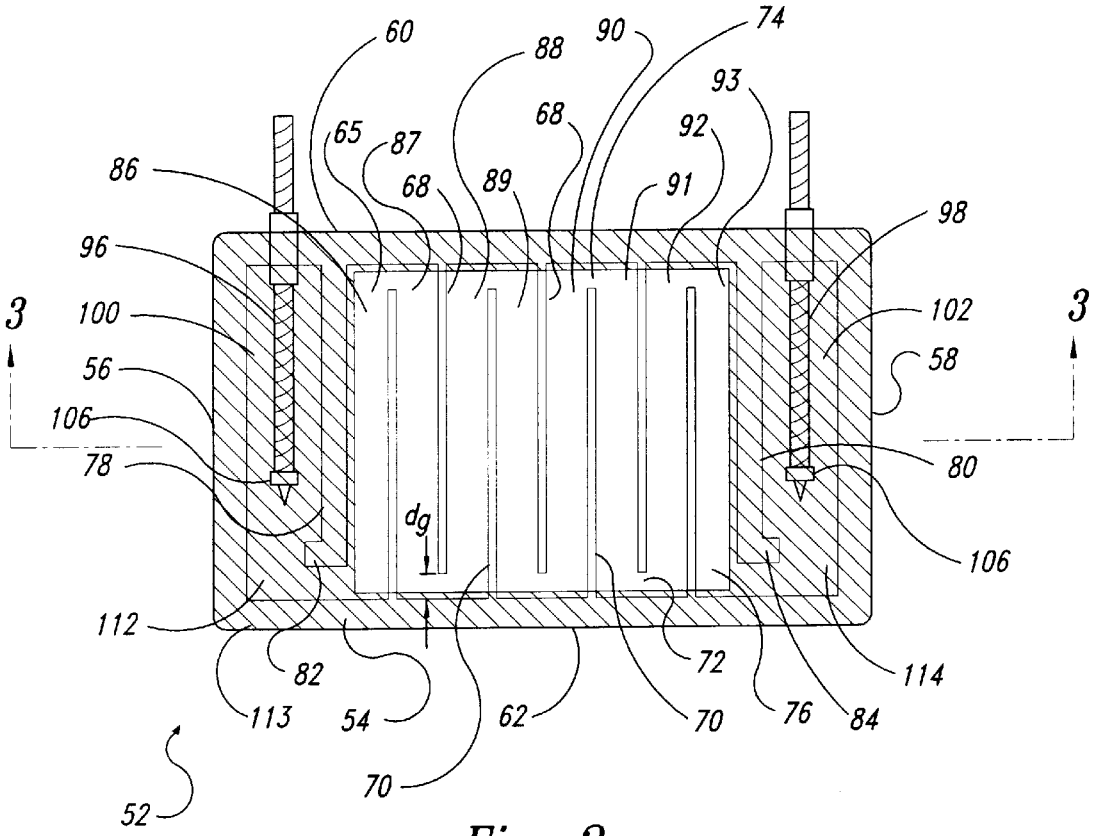
FIG. 2 is a top plan view of a planar fluorescent lamp according to the invention.
Figure 3:
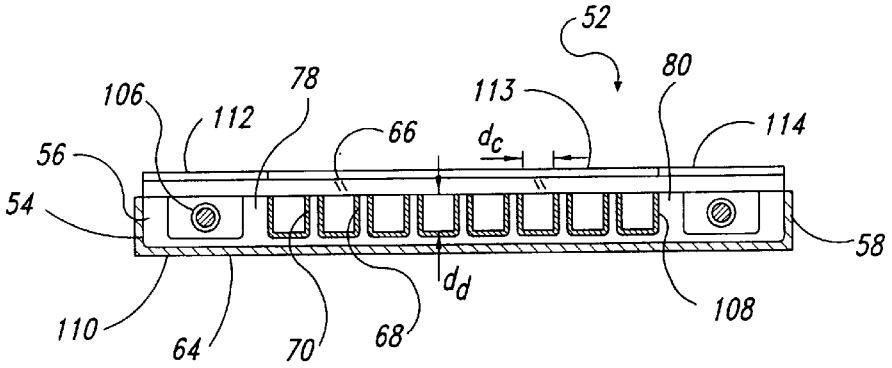
FIG. 3 is a side cross-sectional view of the lamp of FIG. 2.

One of the lamps 52 is shown in greater detail in FIGS. 2 and 3. The lamp 52 has a diagonal measuring 1.5 inches which is sufficient to emit light over an area as large as one of the LCD panels 50 of FIG. 1. The lamp 52 includes a rectangular, insulative lamp body 54 having first and second sidewalls 56, 58, first and second endwalls 60, 62, and a base 64. The base 64, sidewalls 56, 58 and endwalls 60, 62 are integrally formed from an optically transmissive glass with the sidewalls and the endwalls projecting upwardly from the base 64 to form a recess. A transparent cover 66 is bonded to the lamp body 54 at the tops of the sidewalls and endwalls by a glass solder to form a sealed chamber 65 in which a gas containing mercury vapor is placed. The cover 66 is a glass chosen to have a thermal coefficient of expansion matched to that of the lamp body 54, so that, as the lamp 52 is subjected to temperature variations during operation, stress due to thermal expansion and contraction will be minimized.

Integral channel walls 68, 70 project upwardly from the base 54 toward the cover 66 and are sealed to the cover by additional glass solder. The channel walls 68 extend from the first sidewall 60 toward the second sidewall 62, ending a short distance from the second sidewall 62 to leave gaps 72 between the distal ends of the channel walls 68 and the second sidewall 62. Similarly, the channel walls 70 extend from the second sidewall 62 toward the first sidewall 60, ending a short distance from the second sidewall 60 to form similar gaps 74.

Separator walls 78, 80 are positioned intermediate the outermost channel walls 70 and the respective sidewalls 56, 58. Like the channel walls 68, 70, the separator walls are integral to the lamp body 54 and extend upwardly from the base 64 toward the cover 66. The separator walls 78, 80 project from the first endwall 60 toward the second endwall 62, ending a short distance from the second endwall. Respective dogleg walls 82, 84 project transversely from the distal ends of the separator walls toward the respective sidewalls 56, 58, such that the separator walls and dogleg walls form L-shaped insulative barriers within the chamber 65.

As can best be seen in FIG. 2, the endwalls 60, 62, sidewalls 56, 58, separator walls 78, 80, and channel walls 68, 70 define a serpentine channel 76 having eight channel sections 86–93 within the lamp 52. Also, the separator walls 78, 80, sidewalls 56, 58, and end portions of the endwalls 60, 62 form electrode channels 100, 102 parallel to the channel sections 86-93. The dogleg walls 82, 84 are spaced apart from the second endwalls 62 such that passageways are defined between the electrode channels 100, 102 and the outermost channel sections 86, 93. The passageways permit electrons, as discussed below, to pass from the electrode channels 100, 102 to the serpentine channel 76.

Cold cathode-type electrodes 96, 98 for providing electrical energy to the serpentine channel 76 are positioned in the electrode channels 100, 102, respectively. Cold cathode operation of planar fluorescent lamps is known in the art and is described, for example, in U.S. Pat. No. 5,343,116. The electrodes 96, 98 are formed from elongated Ni rods which project from the endwalls 56, 58 into the electrode channels 100, 102. The Ni rods extend through the first endwall 60 with portions of the rods exposed outside of the lamp body 54 to form terminals for connection of electrical power sources to the electrodes. The elongated structure of the Ni rods is preferred because it provides an extended surface area for cold cathode emission of electrons into the chamber 65.

In operation, the electrodes 96, 98 are energized at voltages of approximately 250 volts RMS and at frequencies of approximately 30–50 kHz. At this energization, the lamp 52 produces illumination according to cold cathode operation. That is, electrons are emitted through secondary electron emission and flow through the mercury vapor causing the mercury vapor to emit ultraviolet light. While the lamps 52 are preferably operated at approximately 250 volts and 30–50 kHz, they may be operated over a much wider frequency and voltage range, and have been demonstrated at frequencies from 10 to 100 kHz. Such lamps may also be operated as hot cathode lamps if the electrode structures are modified accordingly.

Glass beads 106 are bonded near the distal ends of the electrodes 96, 98. The glass beads encircle the electrodes 96, 98 to form an insulative barrier around a small portion of the electrodes. While the electrodes 96, 98 are sufficiently rigid to project into the electrode channels 100, 102 without contacting the base 64 under typical operating conditions, the glass beads 106 provide additional protection to prevent the electrodes 100, 102 from contacting the base 64 in high vibration environments or when the lamp 52 is subjected to physical shocks. The distal ends of the electrodes 96, 98 are shaped to form a point to improve uniformity of electron emission from the electrodes 100, 102.

Electrons emitted by one of the electrodes 96, 98 follow a path from one of the electrode channels 100 or 102, through the corresponding passageway and along the serpentine channel 76 toward the opposite electrode channels 102 or 100. Energy from the electrons transfers to the mercury vapor as the electrons travel through the serpentine channel 76. As energy from the electrons is transferred to the mercury vapor, the mercury vapor emits ultraviolet energy. The channel walls 68, 70 and the separator walls 78, 80 form insulative barriers to force the electrons to travel along the serpentine path 76. As the electrons travel, they pass lengthwise through each of the channel sections 86–93. This provides a distance of travel for electrons between the electrodes 100, 102 much greater than the length or width of the lamp 52.

Because the cover 66 is soldered to the sidewalls 56, 58 and endwalls 60, 62, the chamber 65 formed by the lamp body 54 and cover 66 is sealed around the edges. As discussed below, the electrodes 96, 98 are sealed as they pass through the endwalls such that the chamber 65 is completely sealed. Within the chamber 65 is a gaseous environment containing the mercury vapor pressurized at a pressure between 25 torr and 120 torr. This pressure is higher than is typically used for conventional planar fluorescent lamps. The inventor has determined that, in the small lamp structure of the preferred embodiment of the invention, pressures above those used in conventional lamps can significantly improve efficiency, with efficiencies being greatest at about 25 torr for the particular structure of the lamp 52 of FIG. 2. At pressures above 25 torr, the efficiency of the lamp 52 is decreased slightly. However, because sputtering of the electrodes 96, 98 is also reduced, the life of the lamp 52 is extended. The preferred pressure based on lifetime and efficiency considerations for the dimensions discussed below has been determined to be about 70–100 torr.

A fluorescent layer 108 overlays substantially the entire interior portion of the lamp body 54, including the base 64, sidewalls 56, 58, endwalls 60, 62, and channel walls 68, 70, as best seen in FIG. 3. The fluorescent layer 108 is of a known fluorescent material, such as a commercially available rare earth fluorescent phosphor. The fluorescent layer 108 produces visible light in response to the ultraviolet energy produced by the mercury. vapor. Advantageously, the tops of the channel walls 68, 70 are free of fluorescent material to prevent phosphor ions in the fluorescent material from providing a conductive path between adjacent ones of the channel sections 86–93. Preferably, the fluorescent layer 108 does not coat-the lower surface of the cover 66 so that light energy produced within the chamber 65 will be transmitted through the cover substantially unattenuated.

As can be seen from FIG. 3, the channel sections 86–93 are generally rectangular in cross section, though the lower corners of the cross section are slightly rounded to form a smoother cross-sectional shape. The channel sections are relatively shallow, having a depth $d_d$ on the order of 0.080–0.090 inch, though deeper or shallower channels may be within the scope of the invention. In order to contain the electrons within generally a symmetrical channel, the channel walls 60, 67 are separated by a width dc which is similar to the depth of the channel sections, preferably 0.10–0.12 inch. The channel width $d_c$ is generally at least half the depth $d_d$ with a preferred ratio $d_c$:$d_d$ in the range of 0.7:1 to 1.3:1, though lamps having a ratio $d_d$:$d_c$ of greater than 1.3:1 may be within the scope of the invention.

At the turns in the serpentine channel 76, the width $d_g$ of the gaps 72, 74 is slightly less than half the width $d_c$ of the channel sections 86–93, with the width $d_g$ being preferably 0.30–0.50 inch. The depth of the serpentine channel 76 remains substantially constant through the gaps 72, 74. This geometry has been determined to maintain an adequate uniformity of light distribution through the turns in the serpentine channel while forcing electrons to travel close to the endwalls as they travel along the serpentine channel 76 to cause the light to be produced in regions close to the endwalls 60, 62. The electrode channels 100, 102 are considerably wider than the channel sections 86–93, with preferred dimensions of 0.170–0.190 inch.

To further improve the efficiency of the lamp 52, a reflective coating 110 covers the lower surface of the base 64. The reflective coating 110 preferably reflects both the visible and ultraviolet energy so that visible light produced by the fluorescent layer 108 and emitted toward the lower surface of the base 64 is reflected upwardly into the lamp 52 where it can exit through the lamp cover 66. Ultraviolet energy produced by the mercury vapor and not converted by the fluorescent layer 108 to visible light will travel to the reflective coating 110 where it will be reflected back toward the fluorescent layer 108. There it will have a second opportunity to be converted to visible light by the fluorescent layer 108.

As is known, dark regions, known as a Crooke's or Faraday regions, surround the electrodes 96, 98 due to the presence of the conductive material of the electrodes. Because it is desirable that the lamp 52 produce light uniformly for the displays 42 (FIG. 1), the regions above the electrodes 96, 98 are blocked by respective blocking sections 112, 114 of an opaque mask 113 such that only the unmasked channel sections 86–93 emit light toward the observer. While the opaque mask 113 is represented as transparent in FIG. 2 for clarity of presentation of the internal lamp structure, it will be understood that the portions of the lamp 52 overlaid by the opaque mask 113 are not ordinarily visible.

Figure 4:
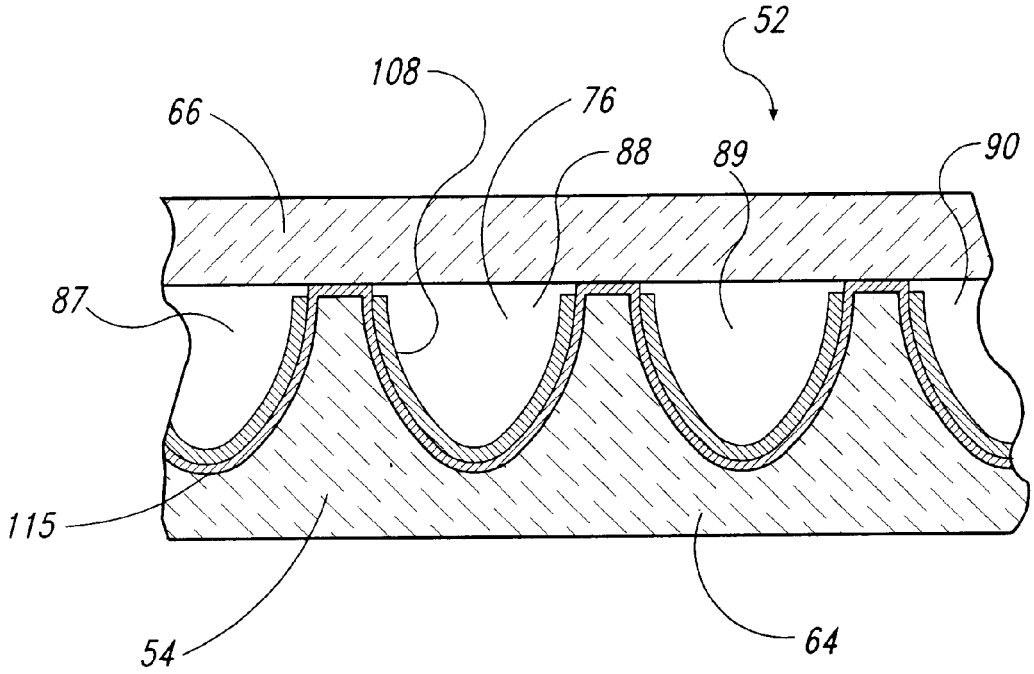
FIG. 4 is a side detail of an alternative embodiment of the invention in cross section.

In an alternative embodiment of the lamp 52, of which a portion is shown in FIG. 4, a reflective layer 115 is placed in a serpentine channel 76 having a parabolic cross section with the fluorescent layer 108 covering the reflective layer 115. The reflective layer 115 within the serpentine channel eliminates the need for the reflective coating 110 on the lower surface of the base 64. Because the reflective layer 115 defines a parabolic barrier to prevent light within the channel from entering the lamp body 54, absorption of light, both ultraviolet and visible, by the lamp body 54 is minimized. Also, ultraviolet light produced within the channel sections 87–90, is reflected by the reflective layer 115 back into the respective channel section: Because the reflective layer 115 defines a parabolic cross section, some of the ultraviolet energy will be reflected directly toward the fluorescent layer 108 at another location on the parabolic surface defined by the cross section of each channel section. There, the ultraviolet energy may be converted to visible light energy which will be emitted through the cover 66 toward a viewer. Advantageously, the light reflected in this manner does not travel through the glass of the lamp body 54 where it would be attenuated.

As with the lamp 52 of FIGS. 2 and 3, the lower surface of the cover 66 is kept free of fluorescent material from the fluorescent layer 108. The reflective layer 115 and fluorescent layer 108 form an optically additive cross section. That is, ultraviolet light striking the fluorescent layer 108 and not converted to visible light is reflected by the reflective layer 115 back into the lamp 52 with a high probability of striking the fluorescent layer 108 at another location. Because the ultraviolet light is likely to strike the fluorescent layer 108 multiple times, the ultraviolet light is more likely to be converted to visible light than in a conventional lamp. Moreover, the reflectively coated lower surface of the serpentine channel 76 operates as a parabolic reflector to reflect visible light within the lamp 52 outwardly toward an observer, further improving the efficiency of the lamp 52. The curved cross-sectional reflective layer 115 and the overlaying fluorescent layer 108 thus define a section of an aperture effect planar fluorescent lamp. As is known, the aperture effect can increase the luminance of tubular fluorescent lamps significantly. The aperture effect in tubular fluorescent lamps discussed in J. E. Kaufman (ed.), *IES Lighting Handbook: The Standard Lighting Guide, Fourth Ed.,* Illuminating Engineering Society, New York, 1966, Section 8, pp. 8–21, which is incorporated herein by reference.

While the cross-sectional shape of the channel sections of the lamp 52 of FIG. 4 is shown as generally curved, several other shapes are within the scope of the invention. For example, the produced lamps having generally V-shaped cross sections, as well as the rounded rectangular cross sections of the device of FIGS. 2 and 3.

Figure 5:
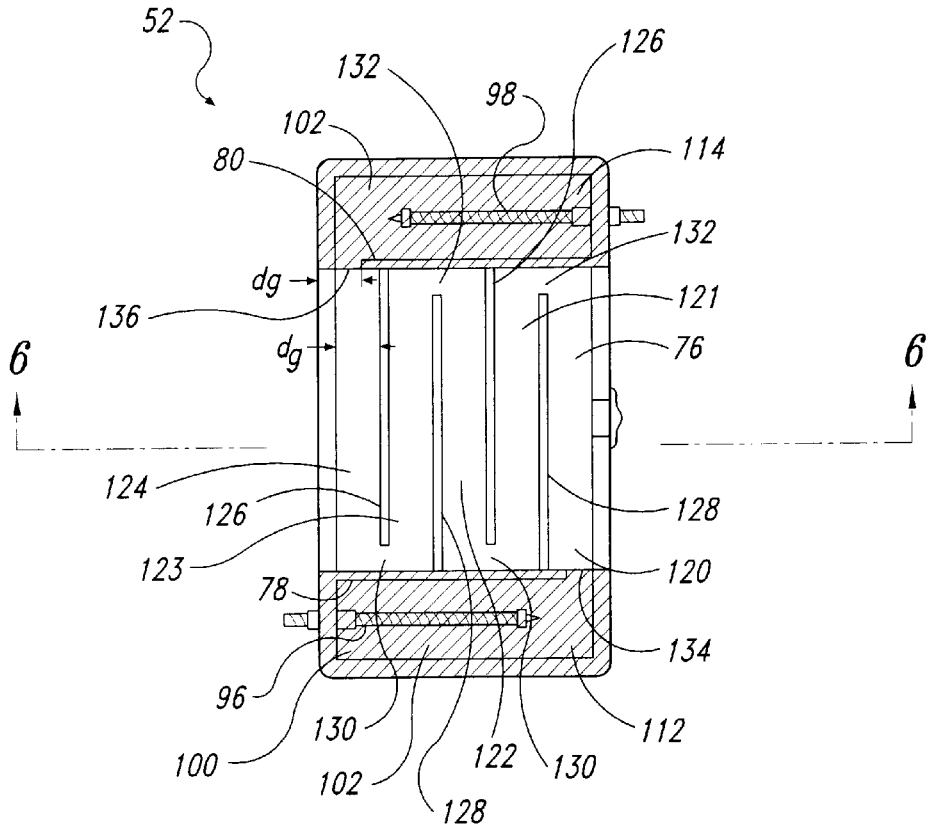
FIG. 5 is a top plan view of an embodiment of the invention having electrodes perpendicular to the channel sections.
Figure 6:
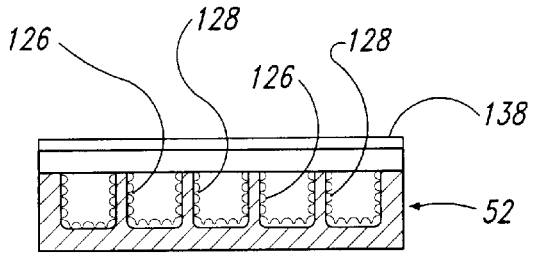
FIG. 6 is a side cross-sectional view of the lamp of FIG. 5.

In another alternative embodiment of the lamp 52 shown in FIGS. 5 and 6, the serpentine channel 76 includes five channel sections 120–124, which are perpendicular to the electrode channels 100, 102. In this lamp 52, channel walls 126, 128 project from one of the separator walls 78, 80 toward the other, ending a short distance from the separator walls to leave gaps 130, 132 between adjacent ones of the channel sections 120–124. To permit electrons to travel from the electrode channels 100, 102 into the serpentine channel 76, passageways 134, 136 are formed in the ends of the first channel section 120 and the fifth channel section 124. To minimize sputtering damage to the electrodes 96, 98, the separator walls 78, 80 extend beyond the outermost channel walls 126, 128 such that the passageways 134, 136 are narrower than the channel sections 120, 124. The portions of the separator walls 78, 80 which block portions of the channel sections 120, 124 provide barriers to ions traveling in the serpentine channel 76 to prevent the ions from traveling directly toward the electrodes 96, 98 and sputtering the electrode material away.

In this embodiment, the electrodes 96, 98 are advantageously positioned adjacent the gaps 130, 132. The electrodes 96, 98 can thus produce electric fields in the gaps 130, 132, which has the effect at low light levels of drawing the illumination toward the center of the lamp 52. Because at low light levels, illumination at the outer edges of the lamp 52 tends to be higher than illumination near the center, the effect of the electrodes 96, 98 being adjacent the gaps 130, 132 is to improve the uniformity of light distribution throughout the lamp at low light levels. As with the lamp 52 of FIGS. 2 and 3, blocking sections 112, 114 of an opaque mask cover the electrodes 96, 98 to define the light-emissive area as the area above the serpentine channel 76.

The lamp 52 of FIGS. 5 and 6 preferably has a diagonal dimension across its active area, i.e., the diagonal measurement between the gaps 134, 136, of approximately 0.7 inches. While this lamp could be made larger, for example, with a 1.5 inch diagonal, like the lamp of FIGS. 2 and 3, or smaller, the 0.7 inch diagonal dimension is preferred for certain headset applications using smaller displays. The serpentine channel 76 in this lamp 52 has a channel width $d_c$ of approximately 0.080–0.090 inch and a gap width $d_g$ of approximately 0.030–0.040 inch. Thus, despite its smaller overall dimensions as compared to the lamp of FIGS. 2 and 3, the channel width $d_c$ of the 0.7 inch lamp is only slightly smaller than that of the larger lamp. It will be understood by one skilled in the art that, though channel widths on the order of 0.10 inch are preferred, lamps of widely differing dimensions may be within the scope of the invention.

Figure 7:
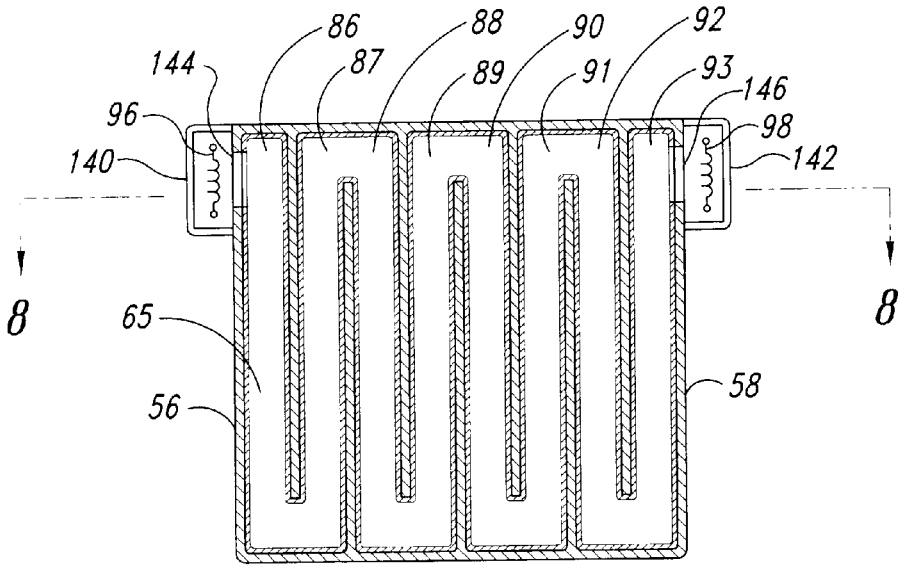
FIG. 7 is a side cross-sectional view of an alternative embodiment of the lamp having secondary electrode chambers.
Figure 8:
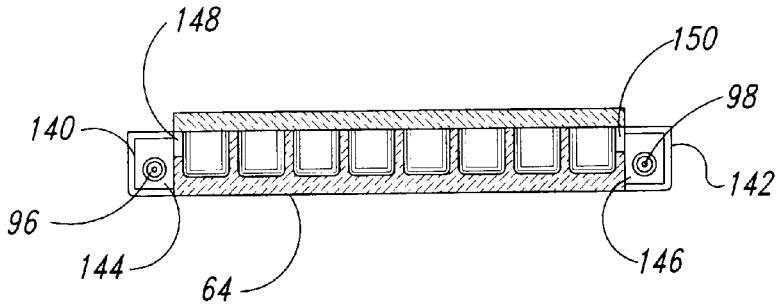
FIG. 8 is a side cross-sectional view of the lamp of FIG. 7.

In a third alternative embodiment shown in FIGS. 7 and 8, all eight of the channel sections 86–93 are used to emit light. In this embodiment, the electrodes 96, 98 are contained in secondary housings 140, 142 which are bonded to the sidewalls 56, 58. The secondary housings 140, 142 are shaped to include recesses which form secondary chambers 144, 146 to accommodate the electrodes 96, 98. To permit electrons emitted by the electrodes to travel through the serpentine channel 76, a pair of slots 148, 150 are formed in the sidewalls 56, 58 to form passageways between the chamber 90 and the secondary chambers. The slots 148, 150 are semi-circular holes through the sidewalls 56, 58, respectively, which permit the gas within the chamber 90 to pass between the secondary chambers and the chamber 65. The secondary housings 140, 142 are sealed to the sidewalls 56, 58 by glass solder such that- the secondary chambers 144, 146 and the chamber 65 together form an airtight enclosure. While the secondary housings 140, 142 are shown as bonded to the sidewalls 56, 58, the secondary housings 140, 142 may be bonded to the lower surface of the base 64. In such an embodiment, the slots 146, 148 would be formed in the base 64. As shown in FIG. 7, the electrodes 96, 98 are hot cathode electrodes; however, cold cathode electrodes within the secondary chambers are within the scope of the invention.

The lamps 52 of FIGS. 1–3 are produced according to the following steps. First, the lamp body 54 is shaped from glass according to known glass fabrication techniques. Then, the reflective coating 110 is deposited upon the lower surface of the base 66. The reflective coating 110 is preferably a glass enamel material which is deposited using conventional techniques, such as spray coating, and cured at a temperature typically in excess of 500° C. A fluorescent material is then sprayed on the upper surface of the lamp body such that the fluorescent material evenly coats the surfaces of the serpentine channel 76. During spraying of the fluorescent material, some fluorescent material is deposited upon the top surfaces of the channel walls, sidewalls, endwalls, and separator walls. Because the lamp cover 66 is not yet attached, the upper surfaces of the walls are exposed and some fluorescent material adheres to the upper surfaces. The unwanted fluorescent material may be removed from the upper surfaces of the walls using, conventional cleaning techniques. The fluorescent material is then baked to form the hardened fluorescent layer 108.

The glass solder is then deposited on the upper surfaces of the endwalls 60, 62, sidewalls 56, 58, channel walls 68, 70, and separator walls 78, 80 using known screening techniques. The electrodes 96, 98 are inserted into apertures in the endwalls and glass solder is applied such that the solder surrounds the electrodes 96, 98, leaving the ends exposed outside of the lamp body 54 to provide terminals for connection of electrical power sources. The lamp 52 is then heated to glaze the glass solder and the cover 66 is placed atop the lamp body 54. The lamp body 54 and lamp cover 66 are heated again to reflow the solder to form a continuous seal between the lamp cover and the lamp body to form the sealed chamber 65. The glass solder holding the electrodes 96, 98 in place is also hardened during this reflow process. After the lamp 52 cools, the opaque mask 113 including the blocking sections 112, 114 is formed by silk-screening black ink using known silk-screen techniques.

The lamp 52 of FIGS. 5 and 6 is produced according to substantially the same method, except that the reflective coating 10 is not applied to the lower surface of the lamp body 54. Instead, the reflective coating 115 is applied to the interior surface of the lamp body 54 prior to spraying the fluorescent material.

The lamp of FIG. 7 is also formed according to substantially the same method as the lamp 52 of FIGS. 1–3. In this embodiment however, the electrodes 96, 98 are inserted into the secondary housings 140, 142 rather than the lamp body 54. The secondary housings 140, 142 are then bonded to the lamp body 54 using a glass solder.

From the foregoing, it will be appreciated that, although embodiments of the invention have been described herein for purposes of illustration, various modifications may be made without deviating from the spirit and scope of the invention. Accordingly, the invention is not limited except as by the appended claims.

What is claimed is:

1. A planar fluorescent lamp, comprising:

an insulative lamp body including a base having an upper surface and a lower surface and a pair of sidewalls connected to the base and first and second endwalls connected to the base;

a lamp cover having a lower surface, the cover being attached to the lamp body and overlaying the lamp body to define a chamber;

a gas within the chamber, the gas being responsive to emit ultraviolet energy in response to an electrical stimulation;

first and second electrodes positioned to provide the electrical discharge through the gas; and first and second channel walls within the chamber, the first and second channel walls projecting from the base toward the cover, the first channel wall extending from the first endwall toward the second endwall and the second channel wall extending from the second endwall toward the first endwall, the base, endwalls and channel walls defining a serpentine channel within the chamber, the first channel wall being adjacent to and separated from the second channel wall by a maximum separation distance $d_c$ and the lower surface of the cover being separated from the upper surface of the base by a maximum distance $d_d$, wherein the ratio of $d_c$:$d_d$ exceeds 0.5:1.

2. The lamp of claim 1 wherein the ratio of $d_c$:$d_d$ is between 0.7:1 and 1.3:1.

3. The lamp of claim 1 wherein the serpentine channel includes a plurality of channel sections, each channel section having a substantially arcuate cross section for the serpentine channel.

4. The lamp of claim 3 wherein the gas is at a pressure between 70 torr and 120 torr.

5. The lamp of claim 3 wherein the arcuate section is defined by the upper surface of the base and a portion of the channel walls to form an optically additive reflector, further including a layer of fluorescent material overlaying a portion of the base, and portions of the first channel wall and the second channel wall, the layer of fluorescent material having a gap forming an aperture to permit light to exit the optically additive reflector through the cover.

6. The lamp of claim 4 wherein the ratio of $d_c$:$d_d$ is between 0.7:1 and 1:3 and the gas is at a pressure greater than 70 torr.

7. The lamp of claim 3, further including an optically reflective layer positioned to reflect light energy generated within the serpentine channel back into the serpentine channel.

8. The lamp of claim 7 wherein the optically reflective layer overlays the lower surface of the base.

9. The lamp of claim 1, further including:

a secondary housing bonding the lamp body, the secondary housing and a portion of the lamp body forming a secondary chamber wherein the first electrode is positioned within the secondary chamber; and a plasma slot in the lamp body, the plasma slot forming a passageway between the chamber and the secondary chamber.

10. A planar fluorescent lamp, comprising:

an insulative lamp body having a base and a plurality of sidewalls supported by the base;

a lamp cover attached to the lamp body such that the lamp cover and lamp body define a sealed chamber;

a plurality of channel walls within the chamber, the channel walls extending between the base and the cover, the channel walls, and sidewalls, defining a serpentine channel within the chamber;

a gas containing mercury vapor within the chamber at a pressure exceeding 25 torr for producing ultraviolet light in response to an electrical excitation;

a fluorescent material within the chamber for providing visible light in response to the ultraviolet light; and first and second electrodes positioned within the chamber for providing the electrical excitation to the gas.

11. The lamp of claim 10 wherein the serpentine channel includes a plurality of channel sections, each channel section having a maximum cross-sectional width less than 0.120 inch.

12. The planar fluorescent lamp of claim 11 wherein the lamp body is substantially rectangular having a diagonal dimension less than 1.5 inches.

13. The lamp of claim 10, further including a first separator wall defining a first electrode channel within the chamber, adjacent the serpentine channel, wherein the first electrode is positioned within the first electrode channel.

14. The lamp of claim 13 wherein the serpentine channel includes a plurality of substantially parallel channel sections linked by turns between adjacent channel sections and the first electrode is an elongated electrode oriented perpendicularly with respect to the parallel channel sections and positioned to produce an electric field in a first one of the turns to modify the illumination of the lamp in the first one of the turns.

15. The lamp of claim 14, further including:

a second separator wall adjacent the serpentine channel defining a second electrode channel separate from the first electrode channel, wherein the second electrode is positioned within the second electrode channel.

16. The lamp of claim 15 wherein the second electrode is an elongated electrode oriented perpendicularly with respect to the parallel channel sections and positioned to produce an electric field in a second one of the turns to modify the illumination of the lamp in the second one of the turns.

17. The lamp of claim 16 wherein the separator walls include extending portions defining a passageway between the corresponding electrode channels and the serpentine channel, the passageway having a width less than the width of the serpentine channel.

18. The lamp of claim 15, further including an opaque mask overlaying the first and second electrode channels.

19. The planar fluorescent lamp of claim 18, further including a reflective coating overlaying a lower surface of the base, outside of the chamber, for reflecting light exiting the chamber through the base back into the chamber.

20. The planar fluorescent lamp of claim 18, further including a reflective coating within the sealed chamber, the reflective coating having a gap positioned to allow the visible light to exit the sealed chamber through the lamp cover.

21. A planar fluorescent lamp, comprising:

an insulative lamp body having a base and a plurality of sidewalls connected to the base;

a lamp cover having a lower surface and attached to the lamp body, the cover and lamp body defining a chamber;

a plurality of channel walls within the chamber, the channel walls projecting from the base toward the cover, the channel walls, sidewalls, base and cover defining a serpentine channel having an optically additive cross-sectional shape;

a gas within the chamber, the gas being active to emit ultraviolet energy in response to an electrical discharge through the gas; and a coating of a fluorescent material within the chamber for converting the ultraviolet energy to visible light, the coating overlaying the interior of the chamber and conforming to the optically additive cross section, the coating having a gap therethrough, the gap being positioned to provide a passageway for light within the chamber to be transmitted through the cover.

22. The planar fluorescent lamp of claim 21 wherein the optically additive cross sectional shape of the serpentine channel is substantially parabolic.

23. The planar fluorescent lamp of claim 21 wherein the gas containing mercury vapor within the chamber is at a pressure exceeding 25 torr.

24. The lamp of claim 21, further including first and second channel walls within the chamber, the first and second channel walls projecting from the base toward the cover, the first channel wall extending from the first endwall toward the second endwall and the second channel wall extending from the second endwall toward the first endwall, the base, endwalls and channel walls defining a serpentine channel within the chamber, the first channel wall being adjacent to and separated from the second channel wall by a maximum separation distance $d_c$ and the lower surface of the cover being separated from the upper surface of the base by a maximum distance $d_d$, wherein the ratio of $d_c$:$d_d$ exceeds 0.5:1.

25. The lamp of claim 24 wherein the serpentine distance $d_c$ is between 0.080 inch and 0.120 inch.

26. The lamp of claim 25 wherein the serpentine channel includes adjacent linear portions having a center-to-center spacing of less than 0.10 inch.

27. The lamp of claim 24 wherein the ratio of $d_c$:$d_d$ is between 0.7:1 and 1.3:1 and the gas is at a pressure greater than 70 torr.

* * * * *